US005370373A

United States Patent [19]

Bruner et al.

[11] Patent Number: 5,370,373

[45] Date of Patent: Dec. 6, 1994

[54] LACED BORDER SUPPORT SPRING

[75] Inventors: Eric M. Bruner; Steven E. Ogle, both of Carthage, Mo.

[73] Assignee: L&P Property Management Company, Chicago, Ill.

[21] Appl. No.: 47,781

[22] Filed: Apr. 15, 1993

[51] Int. Cl.[5] ..... F16F 3/02

[52] U.S. Cl. ..... 267/97; 267/105; 267/107

[58] Field of Search ..... 267/91, 95–98, 267/86, 88, 103–105, 107–109, 112; 5/260–262, 474, 272, 249, 351, 267, 269; 248/302

[56] References Cited

U.S. PATENT DOCUMENTS

| | | | |
|---|---|---|---|
| 1,008,895 | 11/1911 | Feig | 5/262 |
| 2,145,408 | 1/1939 | Taylor | 267/91 |
| 2,837,143 | 6/1958 | Griffo . | |
| 3,093,840 | 6/1963 | Martin . | |
| 3,121,883 | 2/1964 | Kline | 5/261 |
| 3,200,417 | 8/1965 | Costello | 5/260 |
| 3,206,759 | 9/1965 | Kline | 5/260 |
| 3,353,195 | 11/1967 | Kline | 5/261 |
| 3,708,809 | 1/1973 | Basner | 5/260 |
| 5,149,064 | 9/1992 | Schultz | 267/97 |

*Primary Examiner*—Robert J. Oberleitner
*Assistant Examiner*—Clifford T. Bartz
*Attorney, Agent, or Firm*—Wood, Herron & Evans

[57] ABSTRACT

A border support spring has a pair of complementary torsion wires for providing increased resilient border support to a mattress spring assembly. Each torsion wire of the present invention is bent to have an elongated center section having a pair of spaced ends from which extend divergently projecting transverse arms. Each transverse arm terminates in an end portion which is adapted to be secured to the top or bottom border wire of the mattress spring assembly. The end portions and center sections are each generally orthogonal to the orientation of the transverse arms. The center sections of the pair of torsion wires journal together to prevent relative translational movement, but permit pivotal relative movement between the transverse arms. A helical laced wire is used to journal the center sections of the torsion wires together and extends substantially the entire length of the center sections. The border support spring of the present assembly provides increased resilient border support and reduced opportunity for noise and can be easily assembled and incorporated into the mattress spring assembly.

6 Claims, 2 Drawing Sheets

LACED BORDER SUPPORT SPRING

BACKGROUND OF THE INVENTION

This invention relates generally to bedding mattresses, and more specifically to mattresses having an improved border support.

Typically, a mattress comprises a spring core or so-called spring assembly covered on the top and bottom sides by fabric or cushioning pad and encased with an upholstery covering. The spring core generally comprises rows of coil springs laced together in the top and bottom planes of the springs and surrounded by top and bottom border wires. Additionally, the mattress may have border support springs mounted between the top and bottom border wires to provide additional stiffness or support around the outer border of the mattress.

In normal use the mattress and coil springs are subjected to increased local loading along the borders of the mattress which tends to diminish not only the appearance of the mattress but also the comfort it may provide. For example, sitting on the edge of the bed will depress the top border wire to the point, in time, where it may acquire a permanent deformation. Furthermore, this can result in an uncomfortable tilting or sloping of the bed to one side resulting in a tendency for one to roll to the low side of the bed. The present invention is directed to an improved mattress having resilient support in the form of border support springs around the outer border of the mattress to alleviate these problems.

Even though border reinforcing springs have been developed in various forms, a common problem with these configurations is that the spring structure can be relatively "loose" so that movement of the spring can result in undesirable noise. The noise which results from the use of known border reinforcing springs is a result of the fact that the torsional members which provide the resilient support are not secured tightly together along their entire length. This enables the torsion members to slip relative to one another during use thereby generating the undesirable noise associated with known border reinforcing springs.

Another problem with many forms of border support springs is that they are not sufficiently designed to provide a resilient support structure initially and throughout the life of the mattress. Commonly, border support springs wear out or become ineffective prior to the end of the useful life of the mattress itself. The reason that past border support springs wear out and become ineffective, or are even insufficiently resilient when made, is that the torsion members which are used to construct the spring are only of limited length. Known border springs are constructed by twisting or interlocking a portion of the torsion elements together. This twisted portion does not offer resilient support between the top and bottom border wires. Only the non-twisted length of torsion wire is effectively resilient. Furthermore, these less resilient border springs currently in use are not well suited for mattresses having a large gap between the top and bottom border wires or high profile mattresses. These high profile mattresses are currently inadequately supported around the edges due to the limited resiliency offered by the shorter torsion lengths of known border springs.

The nature of mattress manufacturing is that mattress spring cores, or so-called spring assemblies are generally manufactured in one facility and then shipped to a second facility where the cores are covered and upholstered. In the course of upholstering the spring core of the mattress at the second facility, accessories such as border support springs may be added to a standard core so as to differentiate mattress models or styles. Mattress upholsterers customarily do not have the equipment or the capabilities of the mattress manufacturer; therefore, the assembly and installation of the border support springs must be easily achieved with a minimal amount of effort, expertise, or equipment.

Border support springs currently used in the industry are not easily manipulated for assembly into a manufactured mattress in that they are of fixed construction. The center section of the border support spring must be positioned behind the outer most coil springs with the border spring arms projecting between adjacent coil springs to be attached to the top and bottom border wires. To incorporate the border spring into an assembled coil spring mattress, one end of the border spring having two border spring arms must be inserted between adjacent coil springs and then wrapped around and behind the outer most coil springs until the arms re-emerge at the edge of the mattress to be attached to the top and bottom border wires respectively. The installation of known border support springs into the mattress is very difficult because the arms are fixed in a spaced relationship rendering the "fishing" of the spaced arms into, around, behind, and out of the coil springs very time consuming and labor intensive. Furthermore, the mattress manufacturing industry is highly competitive and the manufacturing costs associated with a given mattress often differentiate between a commercially successful mattress and others.

SUMMARY OF THE INVENTION

It has been an objective of the invention to provide an improved border support spring for use in a mattress spring assembly.

Another objective has been to provide a border support spring which is economical and easy to fabricate and install in the mattress spring assembly.

Another objective has been to provide a border support spring which offers increased resiliency while reducing the opportunity for noise.

These objectives of the invention are obtained by a laced border support spring having a pair of complementary torsion wires. Each torsion wire is bent to have an elongated center section, and extending from each end of the center section is a transverse arm. The transverse arms on each torsion wire extend divergently from and are perpendicular to the axis of the center section. Each transverse arm terminates in an end portion which is secured to either the top border wire or the bottom border wire of the mattress spring assembly. Each torsion wire is configured such that one transverse arm extends downward and outward toward the bottom border wire and the other transverse arm extends upward and outward toward the top border wire of the mattress.

The center sections of the pair of torsion wires of the present invention are secured to one another in a side-by-side relationship. The center sections are uniquely joined together by a helical lacing wire which is wrapped around the entire length of the center sections. In that the entire length of the center sections are joined together without twisting or interlocking the torsion element center sections, the border support spring of the present invention has approximately seven inches of torsional resiliency compared to four inches of torsional resiliency for a similarly sized known border support spring with a twisted portion. This increased torsion length adds more resiliency to the present invention and is better suited to the high profile mattresses.

The helical lacing wire prevents the torsion wires from moving longitudinally and laterally relative to one another. Since the torsion wires of the present invention are secured to prevent relative translational movement the opportunity for noise generated by the present invention will be reduced compared to known border support springs. However, the helical lacing wire does permit the transverse arms of the border support spring to pivot relative to the center section. In this way, the transverse arms of each torsion wire pivot relative to the center section and the pair of complementary transverse arms on one end of the border support spring may be pivoted together and more easily inserted into, around, and out of the coil spring for easy assembly into the spring core mattress without the complicated procedures or assembly hardware currently required.

The end portion of each transverse arm is bent to be perpendicular to the transverse arm and generally parallel to the center section and top and bottom border wires of the mattress spring assembly. As a result, the border support spring can be easily incorporated into a pre-assembled mattress assembly by securing the end portion of each transverse arm within a helical border wire commonly used on the top and bottom border wires for attachment of the border wires to the spring assembly.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
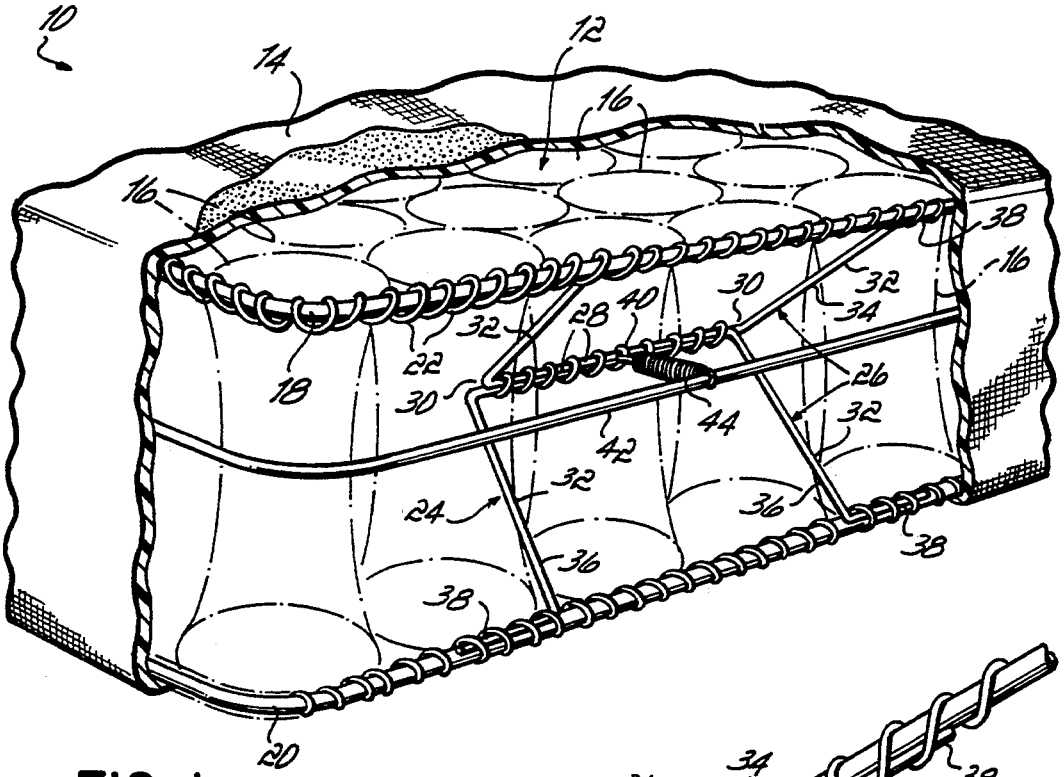
FIG. 1 is a perspective view, partially broken away, of a corner portion of a mattress assembly which includes a border support spring of the present invention.

Referring to FIG. 1, there is illustrated a mattress 10 which comprises a spring assembly 12 and an upholstered covering 14 overlying the spring assembly 12. The spring assembly 12 includes a plurality of coiled springs 16, a top border wire 18, and a bottom border wire 20. The top border wire 18 and bottom border wire 20 are substantially rectangular and are spaced apart by the coiled springs 16. The outermost or peripheral coil springs 16 are attached to the top border wire 18 and the bottom border wire 20 by helical border wire 22.

FIG. 1 also shows a border support spring 24 according to the present invention positioned between the top border wire 18 and bottom border wire 20. A plurality of border support springs 24 may be spaced around the periphery of the spring assembly 12 as desired. As can be more clearly seen in FIG. 2, each border support spring 24 comprises a pair of torsion wires 26, 26 which are each formed from a length of wire bent to have an elongated center section 28 which functions as the resilient or twisting element of the border support spring 24. Extending from each end 30,30 of the center section 28 is a transverse arm 32 which in the preferred embodiment of the present invention is generally perpendicular to the elongated center section 28. The transverse arms 32, 32 of each torsion wire 26 extend divergently from the center section 28. Therefore, one transverse arm 34 on each torsion wire 26 projects upwardly and outwardly towards the top border wire 18 of the mattress spring assembly 12; whereas, the other transverse arm 36 of each torsion wire 26 extends downwardly and outwardly toward the bottom border wire 20 of the mattress spring assembly 12.

Figure 2:
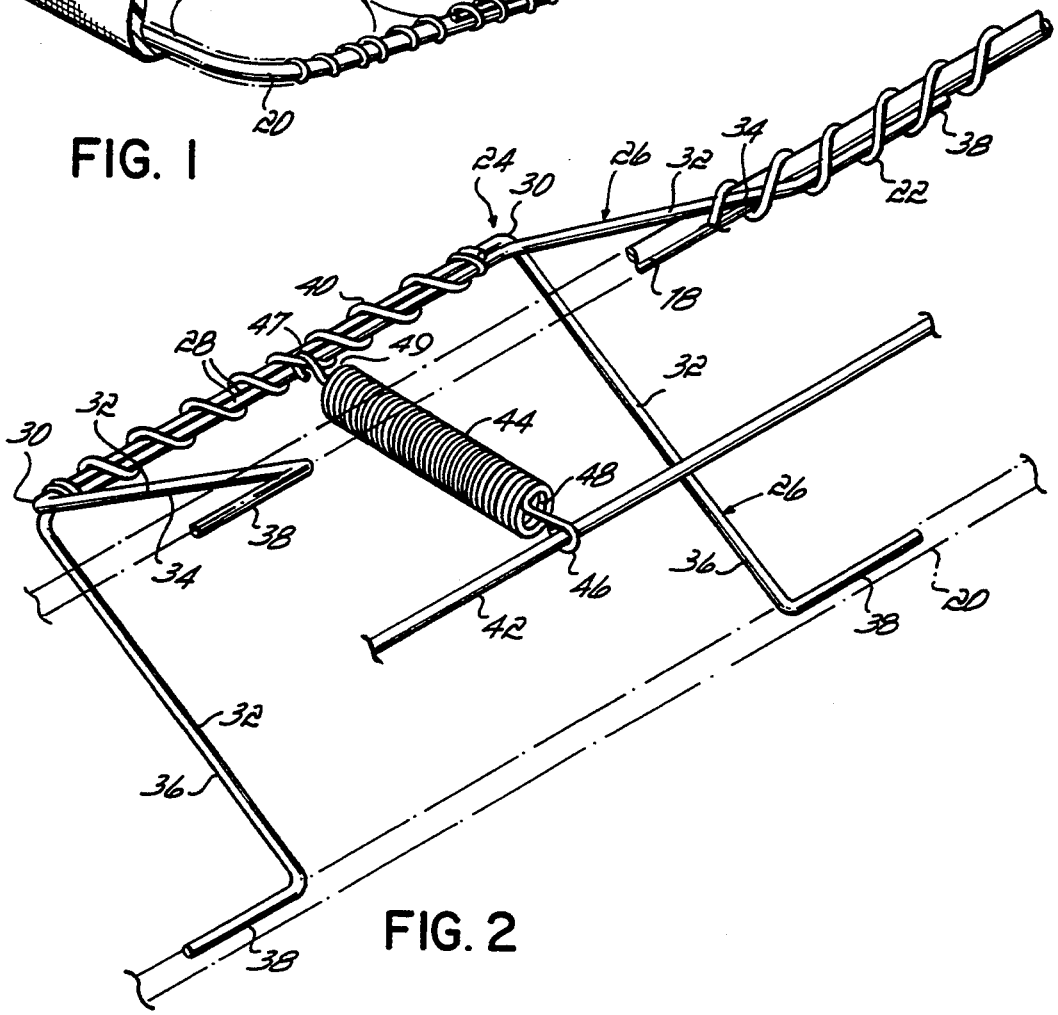
FIG. 2 is an enlarged perspective view of the border support spring attached to upper and lower border wires of the spring assembly of FIG. 1.

Each transverse arm 32 terminates in an end portion 38 which is generally perpendicular to the transverse arm 32 and parallel to the center section 28. The end portion 38 is adapted to be secured to the top border wire 18 or bottom border wire 20. As can be seen in FIGS. 1 and 2, the end portion 38 is wound within the helical border wire 22 thereby securing it to the top 18 or bottom 20 border wire. According to the preferred embodiment of the present invention, the end portions 38 of each transverse arm of the border support spring are bent outwardly from the center section 28. However, it will be appreciated that any suitable mechanism or orientation for the end portion 38 which provides a secure attachment to the top 18 and bottom 20 border wires is within the scope of the present invention.

Figure 3:
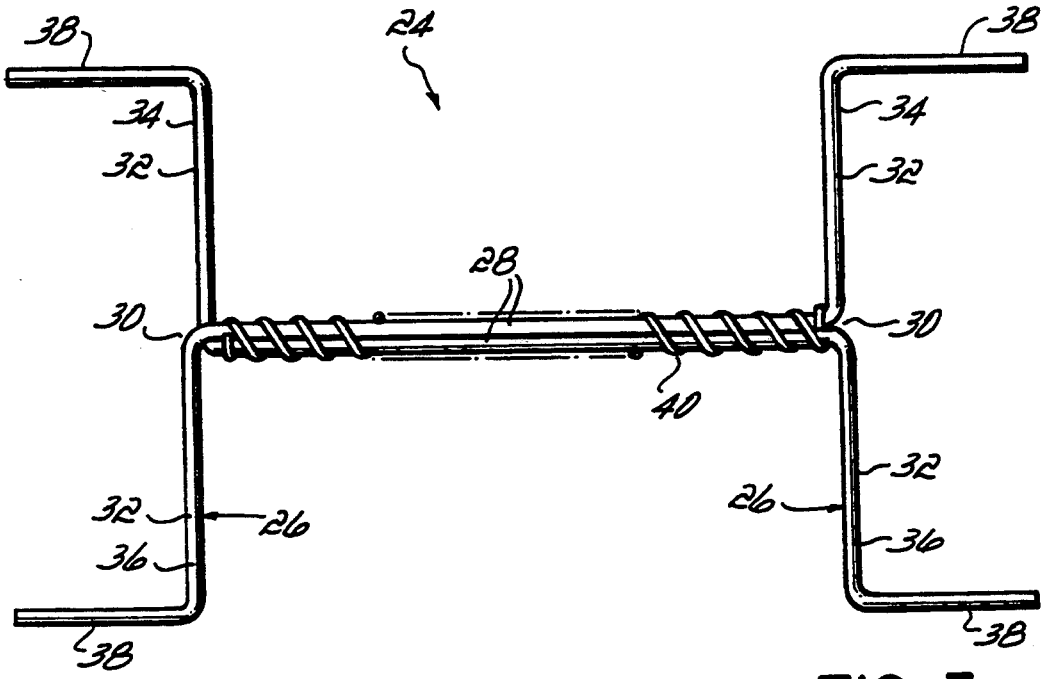
FIG. 3 is a front elevational view of the border support spring of the present invention.

The center sections 28, 28 of the pair of torsion wires 26, 26 are journaled or secured together so that relative translational movement between the torsion wires 26, 26 is prevented. However, the attachment of the center sections 28, 28 must not prevent the pivoting or rotational movement of the transverse arms 32, 32. In the present invention, a helical laced border wire 40 is used to secure the center sections 28, 28 together. The helical laced wire 40 extends substantially the entire length of each center section 28. The helical laced wire 40 offers an economical and easily incorporated attachment mechanism for the center sections 28, 28 while providing highly resilient and functional border support springs. Referring to FIG. 3, it will be appreciated that the pair of torsion wires 26, 26 of the present invention are secured together by the helical lacing wire 40 in a complementary, mutually supporting combination. The center sections 28, 28 are journaled together in side-by-side relation and encircled by the helical lacing wire 40. In a preferred embodiment of the present invention, the center sections 28, 28 are approximately seven inches in length which is longer than currently known border springs. This is possible due to the advantageous attachment mechanism of the center sections 28, 28; namely, the helical lacing wire 40. The longer center sections 28, 28 offer added resiliency and an opportunity for use in higher profile mattresses.

An alternative feature which may be incorporated into the border support spring 24 of the present invention is also shown in FIGS. 1 and 2. A middle border wire 42 may be incorporated between the top border wire 18 and the bottom border wire 20 of the mattress spring assembly 12. If provided, a helical spiral spring 44 may be positioned between the center sections 28, 28 of the torsion wires 26, 26 and the middle border wire 42. In a preferred embodiment of this feature, an arcuate clip 46 is provided on a first 48 end of the spring 44 which is suitable for attachment to the middle border wire 42. An arcuate clip 47 provided on an opposite spaced end 49 of the spring 44 is laced within the helical lacing wire 40 to prevent the spring 44 from sliding along the length of the center sections 28, 28. The provision of the middle border wire 42 and spring 44 adds additional resilient support to the border support spring 24.

When the mattress spring assembly 12 is compressed, the spacing between the top border wire 18 and the bottom border wire 20 tends to decrease. The border support spring 24 of the present invention would provide resilient support in that as the top and bottom border wires are deflected, the transverse arms 32, 32 extending from the center section 28 of each torsion wire 26 will deflect or pivot toward the complementary transverse arm 32 of the other torsion 26 wire thereby providing the resilient support between the top 16 and bottom 18 border wires of the mattress 10. As the border support spring 24 is compressed in this manner, the center sections 28, 28 of the torsion wires 26, 26 will tend to deflect toward the interior of the mattress and the spring coiled assemblies 16. If provided, the spring 44 and middle border wire 42 mechanism will add resiliency to the center sections 28, 28 as they deflect toward the interior of the mattress 10 thereby providing enhanced mattress support.

It will be appreciated by those of ordinary skill that the geometric relationship of the torsion wire 26, the center section 28, the transverse arm 32, and the size or gauge of the torsion wire 26 may be varied to provide the desired spring effect within the elastic limits of materials used in constructing the border support spring 24 support of the present invention.

From the above disclosure of the general principles of the present invention and preceding detailed description of a preferred embodiment, those skilled in the art will readily comprehend the various modifications to which the present invention is susceptible. Therefore, I desire to be limited only by the scope of the following claims.

I claim:

1. A border support spring for use in a mattress spring assembly for providing resilient support between a top border wire located in a top plane of the mattress spring assembly and a bottom border wire located in a bottom plane of the mattress spring assembly, said border support spring comprising:

a pair of torsion wires, each said torsion wire bent to have an elongated center section having spaced ends, a transverse arm extending from each said spaced center section end, said transverse arms of each said torsion wire extending divergently from the axis of said center section, each said transverse arm terminating in an end portion being adapted to be secured to the top and bottom border wires respectively of said mattress spring assembly;

a helical lacing wire around both of said center sections to secure said center sections to one another in side-by-side relation to prevent relative translational movement but to permit relative pivotal movement between said pair of torsion wires, and said helical lacing wire extending substantially the entire length of said center sections of said pair of torsion wires;

a middle border wire located between the top border and the bottom border wire of the mattress spring assembly; and resilient means for directly connecting said middle border wire to said helical lacing wire around said pair of torsion wires.

2. The border support spring of claim 1 wherein each said transverse arm of each said torsion wire is generally orthogonal to said center section and to each said end portion, and said transverse arms are generally parallel to each other.

3. The border support spring of claim 1 wherein one of said transverse arms of each said torsion wire extends downwardly and outwardly toward the bottom border wire and the other of said transverse arms extends upwardly and outwardly toward the top border wire.

4. The border support spring of claim 1 wherein said resilient means comprises a spiral helical spring having a first end adapted to be secured to said middle border wire and a second spaced end adapted to be secured to said helical lacing wire around said center sections of said pair of torsion wires.

5. A border support spring for use in a mattress spring assembly for providing resilient support between a top border wire located in a top plane of the mattress spring assembly and a bottom border wire located in a bottom plane of the mattress spring assembly, said border support spring comprising:

a pair of torsion wires, each said torsion wire being bent to have an elongated center section having spaced ends, a transverse arm extending from each said spaced center section end, said transverse arms of each said torsion wire extending divergently from the axis of said center section, each said transverse arm terminating in an end portion being adapted to be secured to the top and bottom border wires respectively of said mattress spring assembly, each said transverse arm being generally orthogonal to said center section and to each said end portion, said transverse arms being generally parallel to each other, one of said transverse arms of each said torsion wire extending downwardly and outwardly toward the bottom border wire and the other of said transverse arms extending upwardly and outwardly toward the top border wire;

a helical lacing wire around both of said center sections to secure said center sections to one another in side-by-side relation to prevent relative translational movement but to permit relative pivotal movement between said pair of torsion wires, and said helical lacing wire extending substantially the entire length of said center sections of said pair of torsion wires;

a middle border wire located between the top border and the bottom border wire of the mattress spring assembly;

resilient means for directly connecting said middle border wire to said helical lacing wire around said pair of torsion wires.

6. A support spring for bed springs, cushions, or mattresses for providing resilient support between an upper border wire located in an upper plane of the bed spring, cushion, or mattress and a lower border wire located in a lower plane of the bed spring, cushion, or mattress, said support spring comprising:

a pair of torsion wires, each said torsion wire bent to have an elongated center section having spaced ends, a transverse arm extending from each said spaced center section end, said transverse arms of each said torsion wire extending divergently from the axis of said center section, each said transverse arm terminating in an end portion being adapted to be secured to the upper and lower border wires respectively;

a helical lacing wire around both of said center sections to secure said center sections to one another in side-by-side relation to prevent relative translational movement but to permit relative pivotal movement between said pair of torsion wires, and said helical lacing wire extending substantially the entire length of said center sections of said pair of torsion wires;

a middle border wire located between the top border and the bottom border wire of the mattress spring assembly; and resilient means for directly connecting said middle border wire to said helical lacing wire around said pair of torsion wires.

* * * * *